US008305219B2

(12) United States Patent
Yang

(10) Patent No.: US 8,305,219 B2
(45) Date of Patent: Nov. 6, 2012

(54) EAS TAG USING TAPE WITH CONDUCTIVE ELEMENT

(76) Inventor: Xiao Hui Yang, Los Altos, CA (US)

( * ) Notice: Subject to any disclaimer, the term of this patent is extended or adjusted under 35 U.S.C. 154(b) by 484 days.

(21) Appl. No.: 12/726,879

(22) Filed: Mar. 18, 2010

(65) Prior Publication Data

US 2010/0171621 A1 Jul. 8, 2010

Related U.S. Application Data

(63) Continuation-in-part of application No. 12/498,367, filed on Jul. 7, 2009, which is a continuation-in-part of application No. 12/391,222, filed on Feb. 23, 2009, now Pat. No. 8,144,014.

(60) Provisional application No. 61/030,932, filed on Feb. 22, 2008, provisional application No. 61/303,929, filed on Feb. 22, 2008.

(51) Int. Cl.
*G08B 13/14* (2006.01)

(52) U.S. Cl. ..... 340/572.8; 340/572.1; 340/10.1; 340/505

(58) Field of Classification Search ..... 340/10.1, 340/505

See application file for complete search history.

(56) References Cited

U.S. PATENT DOCUMENTS

| | | | | |
|---|---|---|---|---|
| 5,794,464 | A | 8/1998 | Yeager et al. | |
| 5,955,951 | A | 9/1999 | Wischerop et al. | |
| 6,092,401 | A | 7/2000 | Sankey et al. | |
| 6,237,375 | B1 * | 5/2001 | Wymer | 70/14 |
| 7,162,899 | B2 | 1/2007 | Fawcett et al. | |
| 7,168,275 | B2 | 1/2007 | Fawcett et al. | |
| 7,190,272 | B2 | 3/2007 | Yang et al. | |
| 7,251,966 | B2 | 8/2007 | Fawcett et al. | |
| 7,295,114 | B1 | 11/2007 | Drzaic et al. | |
| 7,400,254 | B2 | 7/2008 | Yang et al. | |
| D578,030 | S | 10/2008 | Yang et al. | |
| 7,474,222 | B2 | 1/2009 | Yang et al. | |
| 7,481,086 | B2 | 1/2009 | Fawcett et al. | |
| 7,497,100 | B2 | 3/2009 | Fawcett et al. | |
| 7,497,101 | B2 * | 3/2009 | Fawcett et al. | 70/57 |
| D599,242 | S | 9/2009 | Yang | |
| 7,671,741 | B2 | 3/2010 | Lax et al. | |
| 8,144,014 | B1 * | 3/2012 | Yang | 340/572.1 |
| 2006/0250241 | A1 * | 11/2006 | Renzetti et al. | 340/572.1 |
| 2009/0058659 | A1 | 3/2009 | Handyside et al. | |
| 2009/0289798 | A1 * | 11/2009 | Yang | 340/572.8 |
| 2010/0171621 | A1 * | 7/2010 | Yang | 340/572.9 |
| 2010/0315239 | A1 * | 12/2010 | Yang | 340/572.9 |
| 2011/0115632 | A1 * | 5/2011 | Yang | 340/572.8 |
| 2011/0121973 | A1 * | 5/2011 | Yang | 340/572.8 |
| 2011/0227706 | A1 * | 9/2011 | Yang | 340/10.1 |
| 2011/0260594 | A1 * | 10/2011 | Yang | 312/297 |

* cited by examiner

*Primary Examiner* — Travis Hunnings
(74) *Attorney, Agent, or Firm* — Robert R. Waters; Brian W. Foxworthy; Waters Law Group, PLLC

(57) ABSTRACT

An electronic article surveillance apparatus for monitoring large objects is comprised of a base, at least one segment of tape, and an electronics housing. The segment of tape has a least one electrically conductive element running the length of the tape. The base rests on an object to be monitored, and the housing releasably latches onto the base, while each tape segment wraps around the object with each end of tape segment being fixed between the base and housing. Electronics within the housing complete a circuit through each tape segment and monitor the tape segments for electrical continuity. If electrical continuity is lost, either by cutting a tape segment, or unauthorized unlatching of the housing, an alarm can be sounded by the electronics within the housing. The electronic housing may be disarmed by a remote device and delatched from the base. Both base and tape segments may have adhesive elements.

24 Claims, 10 Drawing Sheets

EAS TAG USING TAPE WITH CONDUCTIVE ELEMENT

CROSS REFERENCE TO RELATED APPLICATIONS

This application is a continuation-in-part application based on U.S. patent application Ser. No. 12/498,367 filed Jul. 7, 2009 which is a continuation-in-part application based on U.S. patent application Ser. No. 12/391,222 filed on Feb. 23, 2009 now U.S. Pat. No. 8,144,014, in turn claiming priority to U.S. Provisional Application 61/030,932, filed on Feb. 22, 2008, and U.S. Provisional Application 61/303,929 filed on Feb. 22, 2008. The entire disclosures contained in U.S. patent application Ser. No. 12/498,367, U.S. patent application Ser. No. 12/391,222, U.S. Provisional Application 61/030,932, and U.S. Provisional Application 61/303,929, including the attachments thereto, are incorporated herein by reference.

FIELD OF INVENTION

The present application is generally related to an electronic article surveillance (EAS) tag, and more specifically, an EAS tag that uses ribbon or tape having a conductive element to attach to objects. For example, the ribbon with conductive element may wrap around a box or similar object. Also, the tag of the present application may be used with various electronic article surveillance (EAS) systems, including for example, an EAS system utilizing tags and deactivators featuring infrared communication for deactivation and alarming and featuring dynamic time based pass code modification and other tamper resistant features, and/or an EAS system using passive element technology.

SUMMARY OF EMBODIMENTS OF THE INVENTION

The present invention is for an electronic article surveillance tag having an electronics housing portion and a base portion which combine with tape or ribbon to attach to boxes or similarly large objects.

The base portion of the EAS tag may have an adhesive element on its back surface so that it will adhere to an object when it is placed on it. The top surface of the base of the EAS tag may have target areas on it. These target areas are located near the edge of the base and facilitate locating the ends of the conductive tape to assist ease of installation. These target areas may be recessions in the surface, outlines in the surface, textured areas, or a symbol such as "X".

The housing portion and the base portion each have complimentary attaching components which allow them to be assembled to each other. In one embodiment, from the top surface of the base of the EAS tags extend hinging hooks and latch receivers which are positioned and adapted to interact with the electronic housing portion of the EAS tag to attach the base portion and housing portion together. A latch in the housing portion of the EAS tag is capable of engaging the latch receivers of the base, while receptacles in a side of the housing portion are positioned to receive the hinging hooks of the base portion. The hinging hooks, latch receivers, latch, and hinging hook receptacles are what hold the assembly together.

On the bottom of the housing portion, there is at least one set of electrical contacts. These electrical contacts are connected to a circuit board or microprocessor within the electronic housing of the EAS tag, and a set of electrical contacts creates a circuit with a section of tape. A strip of tape with conductive element is used for each set of electrical contacts thereby creating an electrical circuit, and when two sets of electrical contacts are used two pieces of tape, two circuits will be created, etc. If any of these strips of tape are cut or otherwise tampered with, the conductive element in the tape will be cut or altered, and this will create an open circuit or other change in resistance, which can be detected by the electronics in the electronic housing portion of the EAS tag. The change in resistance, including a change to infinite resistance due to an open circuit or a change to nearly zero due to a short, is interpreted by the electronics as an alarm condition.

In some embodiments, the electronic housing portion of the EAS tag also has a limit switch protruding from its bottom surface, and the base portion of the EAS tag has an aperture through it in a location matching the location of the limit switch when the housing portion and base portion are assembled. This limit switch detects when the EAS tag has been assembled on a box or other object. The limit switch extends from the surface of the housing portion a distance that is greater than the thickness of the base portion. This allows the limit switch to pass through the aperture of the base portion and detect the presence of an object against the bottom of the base portion.

The electronic housing portion of the EAS tag may have several components within it, including: a microprocessor, a circuit board, a battery, an EAS core and coil element, the limit switch referenced above, an audible alarm producing device, an infrared communication port or other communication elements, and a light emitting diode. The microprocessor or circuit board can detect when the limit switch is depressed and when circuits are created on its electrical contacts to determine that the electrical housing portion of the EAS tag has been joined with a base portion and a conductive ribbon or ribbons on an object. In that condition, the EAS tag may be armed with an arming device that communicates with the tag via the infrared communication port, radio frequency communications, or other communication elements, or the electronics may arm based on the state of the limit switch and closed circuits across the electrical contacts. Once armed, the electronics in the housing portion establish a baseline resistance measurement, and the resistance through the conductive elements of the tape is monitored for deviance from the baseline resistance. The baseline resistance will vary depending on the circumference of the object being protected which determines the length of tape used and therefore the effective resistance due to the length of the conductive element. Some embodiments may employ a latch switch associated with the latch in the housing portion. This latch switch can determine if a latch in the housing portion has engaged with the latch receivers of the base portion.

Once an EAS tag is assembled and armed, unauthorized removal of the tag is detected by the onboard electronics which sense an alarm condition via changes in state of any conditions required to arm the EAS tag, such as changes to the limit switch or resistance in the circuits. In response to a detected alarm condition, the electronics can generate an alarm, including onboard audible alarms, or alarms communicated to the EAS system via infra red signals, radio frequency signals, or other communication methods.

Disarming of the EAS tag may be accomplished by authorized personnel. An authorized person having access to other elements of the EAS system such as a hand held communication device or a base station having communication capabilities may disarm the device. Some embodiments will add another element of security with passcode capabilities in the respective electronics. The EAS tag electronic of these embodiments are capable of storing a passcode which is known to the communication elements of the EAS system and which can be used to confirm to the EAS tag that the disarming signal is authorized. A further element of security can be added by using clock based algorithms to change the passcode synchronously. In those embodiments, the EAS system and the EAS tag both have clock generators and are programmed with the same algorithm and both are programmed with the same initial passcode. As time passes, the algorithm alters the passcode at preset intervals as regulated by the clock generators. This changing passcode further complicates unauthorized attempts to disarm the EAS tag. If an EAS tag is detached without being disarmed with the appropriate passcode, the EAS tag will detect an alarm condition and generate an alarm.

To physically prevent the release of the latch and the detaching of the housing portion from the base portion, a blocking component or mechanism may be employed. In one embodiment, a biased blocking member moves into a blocking position when the latch engages between the housing portion and the base portion. The biased blocking member has a magnetically attractable element associated with it, and when a magnet is applied to the EAS tag, the biased blocking member moves to a position where it no longer blocks the release of the latch. If a magnet is used to detach an EAS tag without authorization and the EAS tag is still armed, the electronics detect an alarm condition and generate an alarm. In some embodiments a magnet may be built into a communication device so that the EAS tag may be disarmed and its latch released for detachment using the same device.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
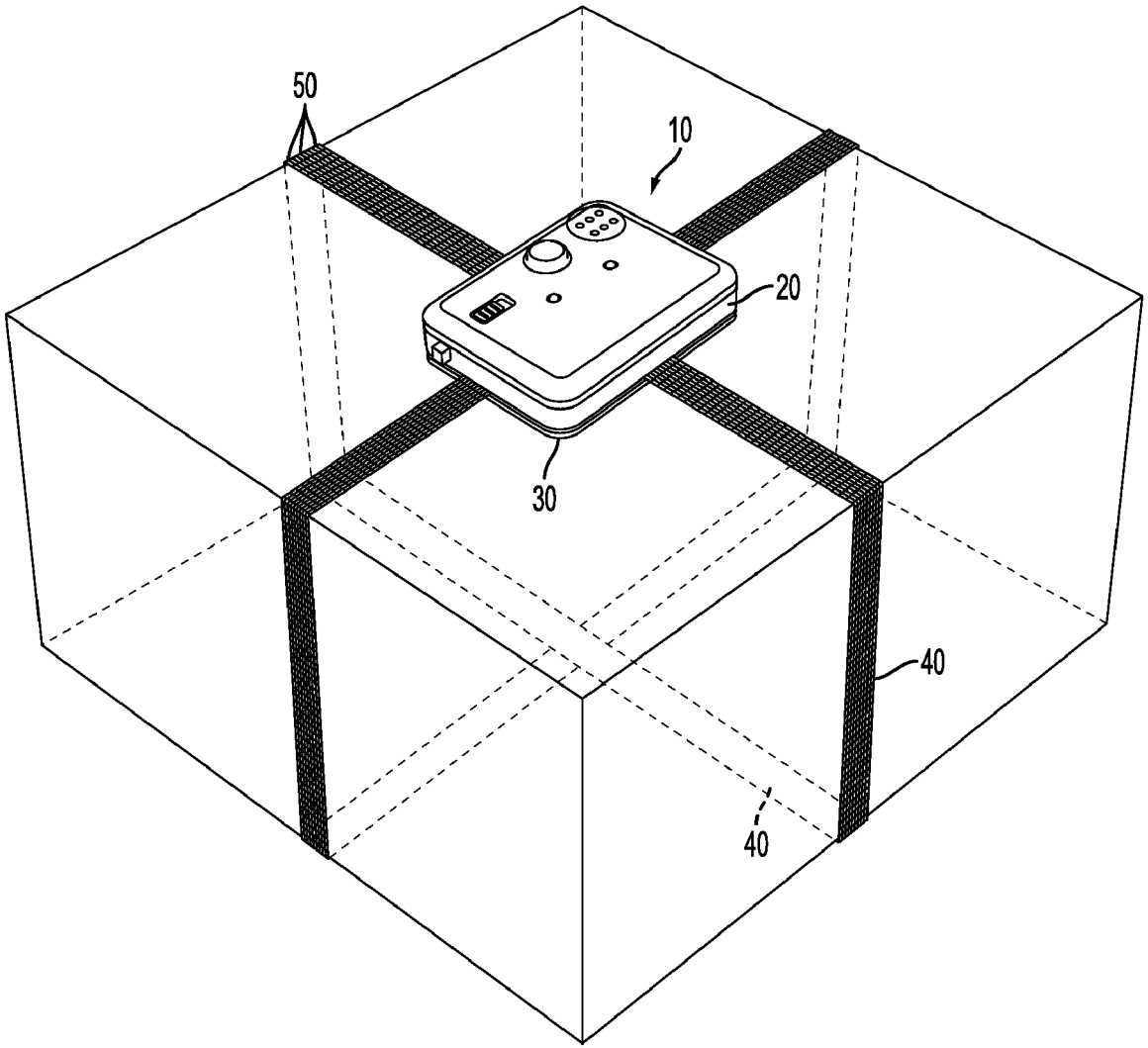
FIG. 1 shows an embodiment of an EAS tag of the present invention affixed to a box.

FIG. 1 shows an embodiment of an EAS tag 10 of the current invention. EAS tag 10 has a housing portion 20, a base portion 30, and tape or ribbon, portion 40. The tape portion 40 wraps around an object, such as a box, that is to be protected and joins with the housing portion 20 and base portion 30. Tape, or ribbon, portion 40 has at least one conductive element 50 running along the length of its top surface. In the embodiment shown in FIG. 1, the at least one conductive elements 50 forms a conductive mesh running the length of tape segments 40.

Figure 2:
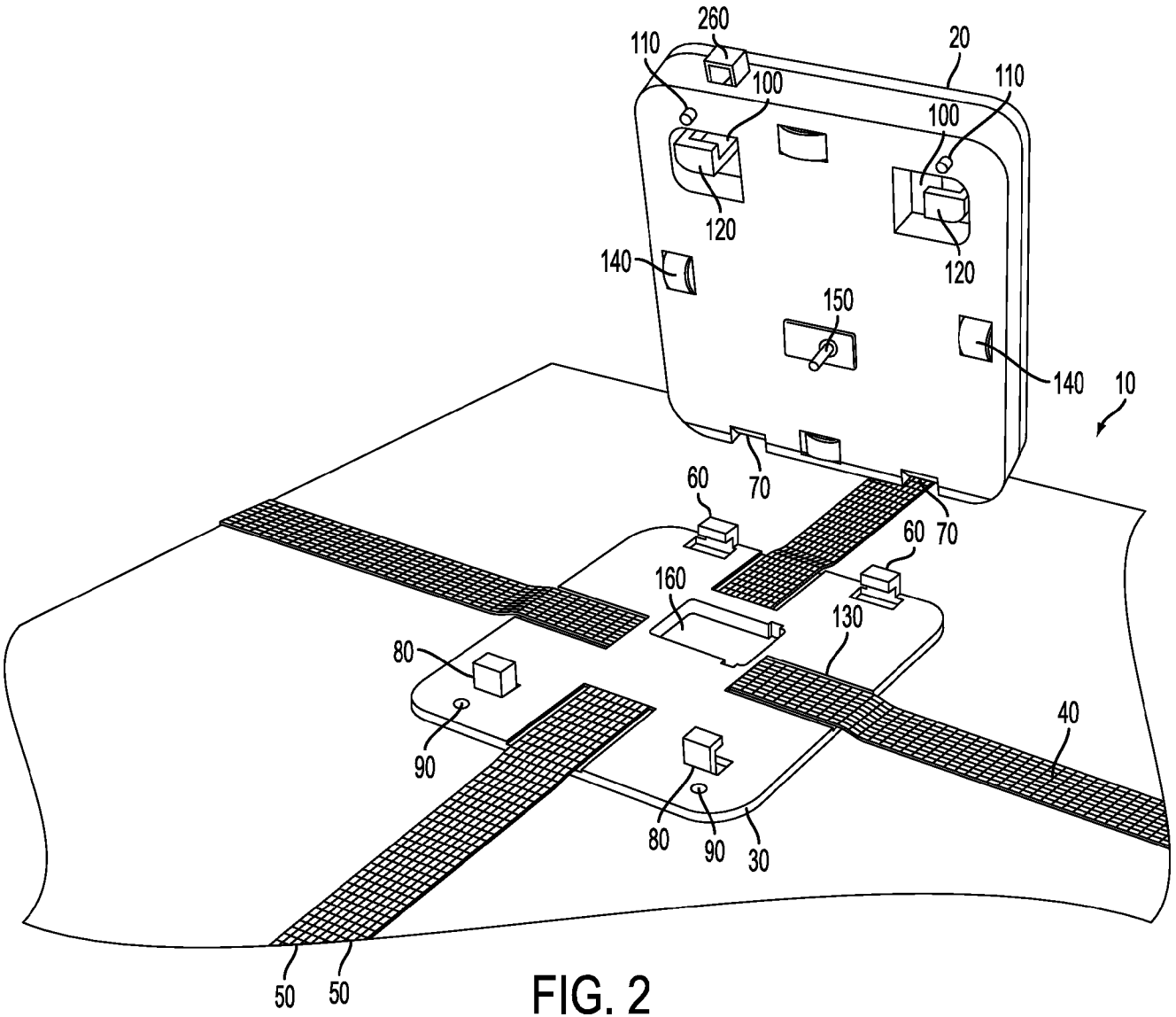
FIG. 2 shows an embodiment of the present invention with its top portion removed.
Figure 6:
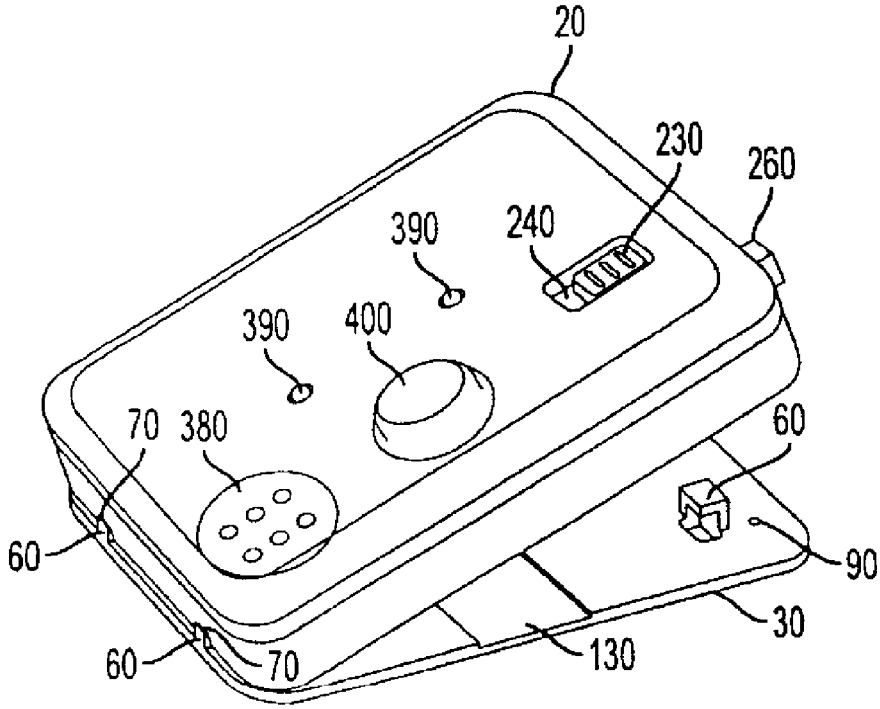
FIG. 6 shows the hinging hooks of a base of an embodiment of the EAS tag engaged in receptacles in the top portion of an embodiment an EAS tag in the process of assembly or disassembly of an EAS tag.

Referring now to FIG. 2, EAS tag 10 is shown with housing 20 removed from base portion 30 and tape segments 40 which are in place on an object to be monitored. Housing portion 20 and base 30 each have complimentary attaching components for assembling housing 20 and base 30 together. In FIG. 2, hinging hooks 60 are visible along the far edge of base portion 60. Not as visible in FIG. 2, are receptacles 70 along the lower side and bottom edge of housing 20. Receptacles 70 of housing 20 are located to match and receive hinging hooks 60 of base 30. FIG. 6 shows housing 20 partially assembled to base 30 with hinging hooks 60 engaged in receptacles 70. In the fore area of base 30 in FIG. 2, latch receivers 80 extend upwardly from the top surface of base 30. Latch receivers 80 are generally formed to engage with a latch element and therefore have a somewhat hooked or concaved shape. This aspect of latch receivers 80 may be more readily observed in FIG. 6. In close proximity to latch receivers 80 in FIG. 2 are alignment apertures 90. In FIG. 2, on the bottom surface of housing 20 and above latch receivers 80 and alignment apertures 90, are located latch pockets 100 and alignment pins 110. Latch pockets 100 are located and sized to receive latch receivers 80 when housing 20 and base 30 are assembled together, while alignment pins 110 are located and sized to fit into alignment apertures 90 in base 30. Visible in latch pockets 100 are latch hooks 120. In the embodiment shown in FIG. 2, latch hooks 120 can be moved to engage latch receivers 80 once housing 20 is assembled to base 30. When housing 20 is assembled to base 30, alignment pins 110 insert into alignment apertures 90 to provide positive location and stability until latch hooks 120 are engaged into latch receivers 80.

Still referring to FIG. 2, target recessions 130 may be seen on the top surface of base 30. Target recessions 130 assist assembly of EAS tag 10 by providing a visual cue for where the ends of tape segments 40 should be located for proper assembly of EAS tag 10. While target recessions 130 are used in the embodiment shown in FIG. 2, other indicators could be used such as a raised outline, or patch of textured surface.

Again referring to FIG. 2, electrical contacts 140 are located on the bottom surface of housing portion 20 of EAS tag 10. Electrical contacts 140 are in electrical continuity with the electronics within housing 20 and are located to make contact with the ends of tape 40 when EAS tag 10 is assembled with tape 40 in place on base 30 and housing 20 attached to base 30. In some embodiments, electrical contacts 140 may have a slight bias away from the bottom surface of housing 20 to assure firm contact between tape 40 and electrical contacts 140. Generally, electrical contacts on opposite sides of the bottom surface of housing 20 are paired to form a circuit with a section of tape 40, and segments of tape 40 in FIG. 2 do not overlap at their ends as tag 10 is installed. This provides at least one continuous circuit about an object to be protected and if a tape segment 40 is tampered with to remove EAS tag 10 without authorization, the electronics can detect this event by monitoring resistance in the circuit, determine an alarm condition, and generate an alarm, such as either an audible alarm or a system alarm. However, some embodiments might use other configurations of electrical circuits. For example, the electronics on board housing 20 could connect the contacts 140 and tapes 40 of FIG. 2 in a single series circuit. In the alternative, if housing portion 20 is removed from base portion 30 without authorization, the electronics can detect the loss of completed circuits through its contacts 140 on the bottom surface of housing 20 and also generate an alarm, either audible or system alarm. EAS tag 10 can generate a system alarm by communicating its change of status with the system via radio frequency communication from the electronics in housing 20 or other forms of communication.

Limit switch 150 extends from the bottom surface of housing 20. Base aperture 160 in base 30 is located to match the location of limit switch 150 when housing 20 is assembled to base 30. The alignment of base aperture 160 with limit switch 150 results in limit switch 150 not being affected by the assembly of housing 20 to base 30 unless the bottom off base 30 is contacting an object. When the bottom of base 30 is contacting an object, as when EAS tag 10 is assembled to an object, shown in FIG. 1 and FIG. 3, limit switch 150 is made and the electronics can interpret this as an arming signal, i.e. EAS tag 10 is installed and communication from an exterior device can initiate secure monitoring of the object.

Figure 3:
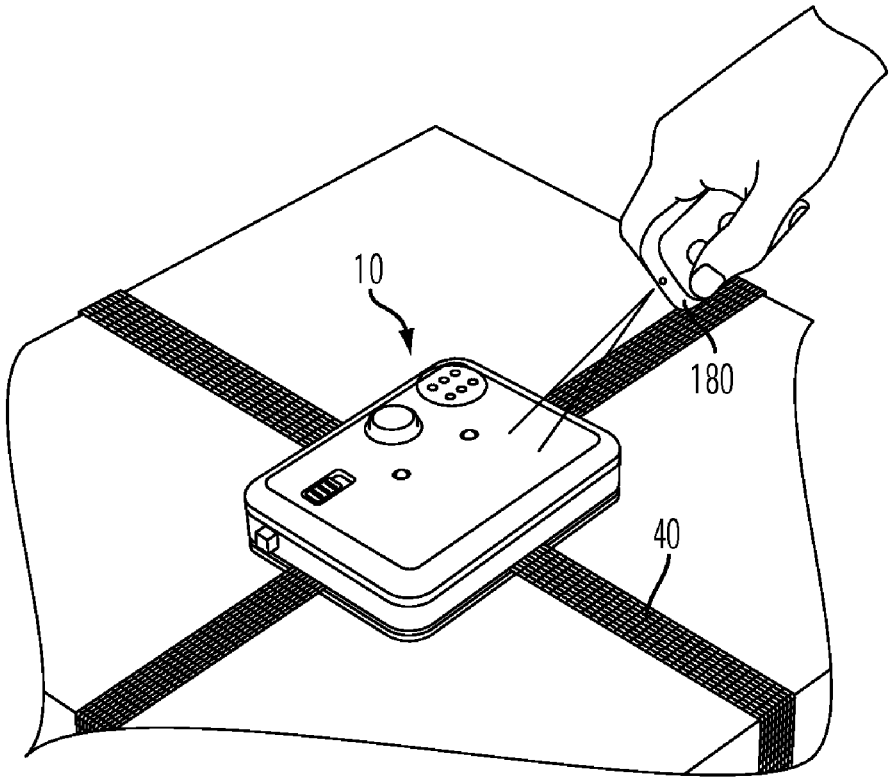
FIG. 3 shows an embodiment of the EAS tag of the current invention being communicated with using a remote device.

FIG. 3 shows a hand held remote 180 activating EAS tag 10. The assembly of EAS tag 10 to an object establishes the conditions for activating EAS tag 10. Hand held remote 180 may communicate with EAS tag 20 with any of several known methods. These methods may include infrared communication and radio frequency communication as well as other known communication methods. Handheld remote 180 may also be used to deactivate EAS tag 10 to allow EAS tag 10 to be removed without causing an alarm. The electronics of some embodiments of EAS tag 10 may have passcode protection. These embodiments are capable of storing a passcode which is required to be matched by handheld remote 180 for the communication from handheld remote 180 to be authorized. For further protection the electronics of some embodiments of EAS tag 10 may include a clock generator and the electronics may have machine readable instructions with an algorithm to change the passcode at preprogrammed time intervals. The EAS system, including handheld remote 180, also has at least one clock generator and is capable of updating the passcode at the preset intervals to update the systems record of the passcode. This keeps the passcode between EAS tag 10 and the rest of the EAS system synchronized.

Figure 4:
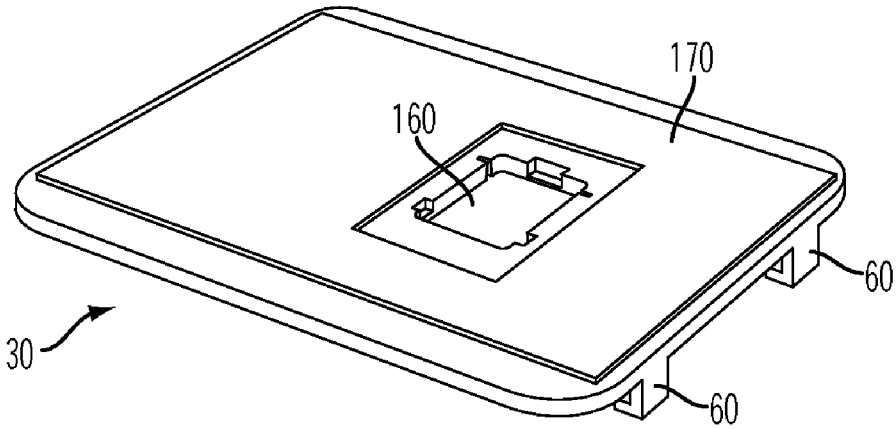
FIG. 4 shows the bottom of the base portion of an embodiment of an EAS tag.

FIG. 4 shows the bottom surface of base portion 30. Bottom surface of base portion 30 has an adhesive element 170. Adhesive element 170 facilitates the assembly of EAS tag 10 on an item to be protected and is constructed, or applied in such a manner as to not cover base aperture 160. Base portion 30 is placed on an item to be protected with adhesive elements 170 on the bottom surface of base portion 30 contacting the object to place the top surface of base portion 30 in an exposed position. At least one tape segment 40 is wrapped around the object to be protected with each end of tape segment 40 being placed on target recessions 130 of base portion 30. If desired, a second tape segment 40 may be wrapped around the object to be protected in a different direction. Once base portion 30 and tape segments 40 are satisfactorily installed on an object desired to be protected, as shown in FIG. 2, housing portion 20 may be installed on base portion 30. Adhesive elements 170 on bottom surface of base portion 30 may be comprised of a pressure sensitive adhesive pad, a pre-applied contact adhesive, or may even be an adhesive applied at the time of use, such as a spray, paste, pressure sensitive adhesive pad, or other applicable adhesive, as long as adhesive element 170 does not cover base aperture 160 and negate the operation of limit switch 150.

Figure 5:
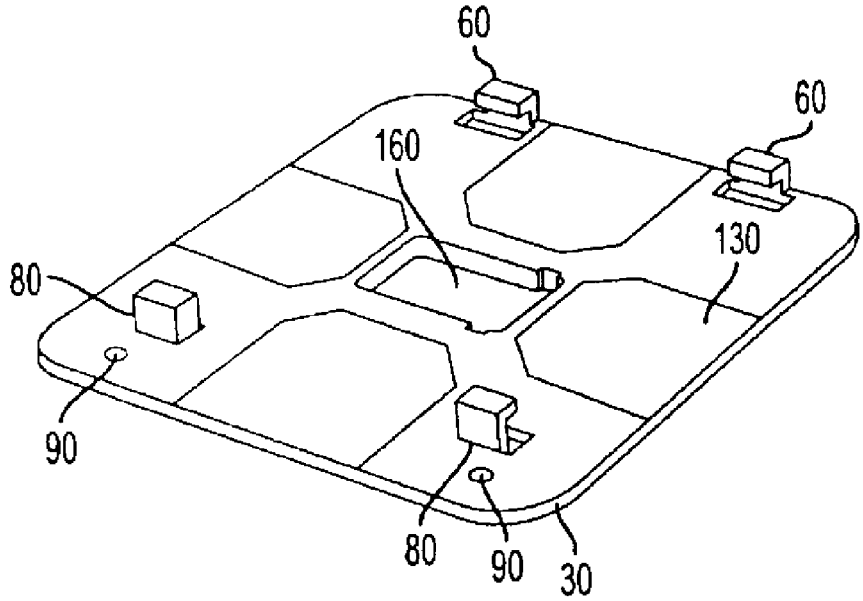
FIG. 5 shows the top of an embodiment of the base for the EAS tag.

FIG. 5 shows the top surface of base 30. Many of the elements visible in FIG. 5, such as the attaching components, have already been described with respect to FIG. 2. Along one edge of base 30 are hinging hooks. Latch receivers 80 extend upwardly from the top surface of base 30 in the opposite half of base 30 from hinging hooks 30. Alignment apertures 90 are located in proximity to latch receivers 80. Base aperture 160 is generally centrally located in base 30 but somewhat offset from exact center in the embodiment shown in FIG. 5. Target recessions 130 occur in opposed matching pairs along the sides of base 30. Target recession 130 provide guidance on where to place the ends of tape segments 40 when EAS tag 10 is being assembled to an object. While target recessions 130 are shown in the embodiment of FIG. 5, other features for providing targets for placement could be used such as outlines in the surface, textured areas, or a symbol such as "X".

FIG. 6 is a perspective view of hinging hooks 60 of base 30 engaging receptacles 70 of housing 20. In FIG. 6, housing 20 is angled upward from base 30 along the edge of base 30 where hinging hooks 60 are located. Hinging hooks 60 of base 30 are engaged in receptacles 70 forming an initial, rotational connection between base 30 and housing 20. To complete assembly of housing 20 to base 30, housing 20 is rotated down onto base 30 where a latch may engage latch receivers 80, shown toward the further end of the top surface of base 30. Latch receivers 80 are shaped to facilitate engagement by a latch.

Figure 7:
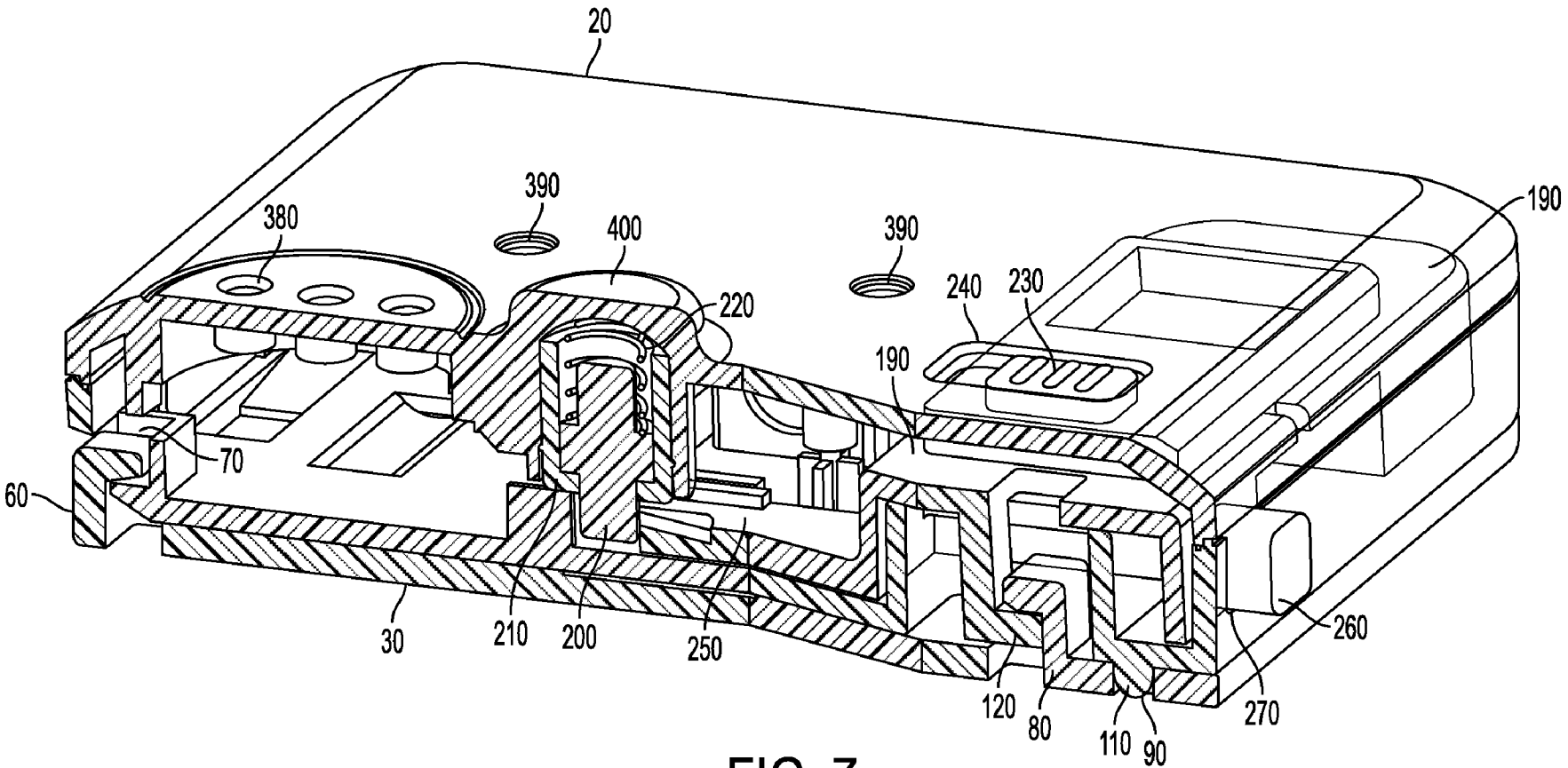
FIG. 7 is a sectioned view of the housing portion and base portion of an embodiment of an EAS tag latched in assembly and showing a latch and blocking component.

FIG. 7 is a sectioned view of housing portion 20 and base portion 30 of an embodiment of an EAS tag 10 latched in assembly and showing a latch 190 holding housing 20 and base 30 together. A blocking component, which in the embodiment of FIG. 7 is a blocking pin 200, prevents disengagement of latch 190. Several elements previously described are visible in the section view of FIG. 7. At the far left, hinging hooks 60 of base 30 are engaged in receptacles 70 of housing 20. Toward the right end of the section, a latch receiver 80 is inserted up into a latch pocket 100 where a latch hook 120 engages latch receiver 80. Further to the right, an alignment pin 110 in housing 20 engages an alignment aperture 90 in base 30.

In the embodiment shown in FIG. 7, latch 190 is a manually operated sliding latch and once it is slid to engage latch hooks 120 into latch receivers 80, blocking pin 200 moves into place to prevent its return to a non-engaged position. Blocking pin 200 is contained within cup 210 and spring 220 biases blocking pin 200 toward a blocking position. In the embodiment of FIG. 7, engagement slide 230 extends upward from the body of latch 190 and is exposed through slide aperture 240 in housing 20, which gives a user access to engagement slide 230 to move latch 190 to an engaged state. When latch 190 is moved to an engaged state, guide 250 on latch 190 is moved out from beneath blocking pin 200 allowing blocking pin 200 to shift position to perform a blocking function. When latch 190 is moved to an engaged position, release button 260 on latch 190 is extended out through button aperture 270 in the side of housing 20.

Figure 8:
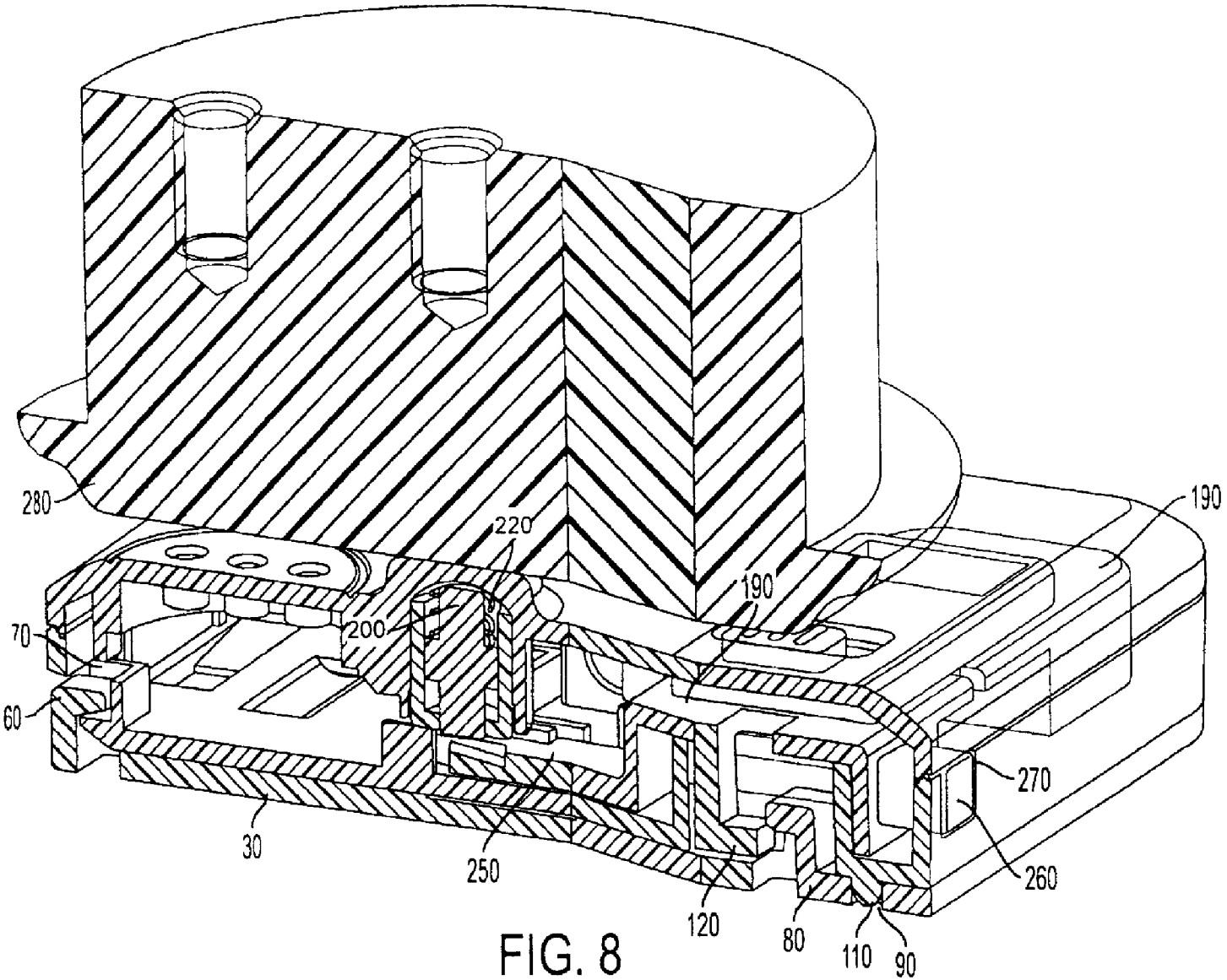
FIG. 8 is a sectioned view of the housing portion and base portion of the embodiment of an EAS tag of FIG. 7 having a magnet applied to shift the blocking component and allow the unlatching of the two portions.

FIG. 8 is a sectioned view of housing portion 20 and base portion 30 of the embodiment of an EAS tag 10 shown in FIG. 7 having a magnet 280 applied to housing 20 to shift blocking pin 200 to a non-blocking position. Blocking pin 200 has some magnetically attractable element associated with it which allows magnet 280 to act upon it to overcome spring 220 and shift blocking pin 200 to the non-blocking position. Once blocking pin 200 is shifted to a non-blocking position, release button 260 may be depressed to shift latch 190 to the left in FIG. 8, moving guide 250 on latch 190 under blocking pin 200 to maintain blocking pin 200 in a non-blocking position. As may be seen in FIG. 8, when release button 260 is depressed and latch 190 is moved to the left, latch hook 120 on latch 190 disengages from latch receiver 80. The disengagement of latch hook 120 from latch receiver 80, allows housing 20 to rotate upward about the interface of hinging hook 60 on base 30 with receptacle 70 on housing 20 seen at the left in FIG. 8. Returning to FIG. 6, housing 20 may be seen engaged with base 30 and rotating about the engagement between hinging hooks 60 and receptacles 70. In the embodiment shown in FIG. 8, the top of release button 260 becomes flush with the side of housing 20 when latch 190 is moved to an unengaged position, and engagement slide 230 moves to the left in slide aperture 240.

Figure 9:
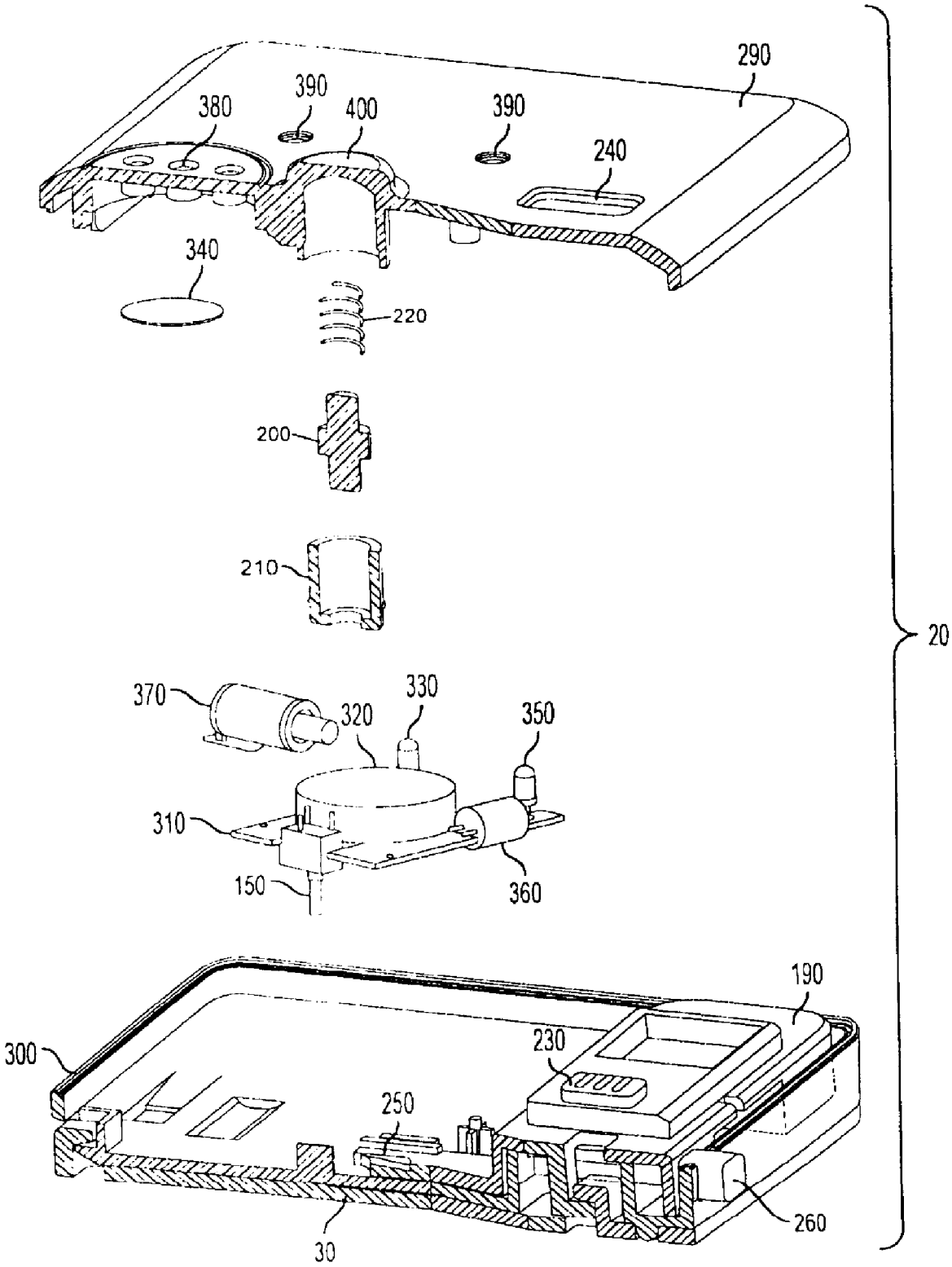
FIG. 9 is an exploded section view of an embodiment of an EAS tag housing portion showing electronics and other internal elements.

FIG. 9 is an exploded section view of an embodiment of an EAS tag 10 housing portion 20 showing electronics and other internal elements. In the embodiment shown in FIG. 9, housing 20 is assembled from two halves, a top half 290 and a bottom half 300 which enclose and support several elements. Latch 190 is seated in bottom half 300, while blocking pin 200, cup 210, and spring 220 are disassembled vertically above bottom half 300. Receptacles 70, latch pockets 100, alignment pins 110, and button aperture 270 are visible on bottom half 300.

FIG. 9 shows the electronics enclosed in housing 20. Circuit board 310 provides a mount for several of the electronic components. In the embodiment shown in FIG. 9, limit switch 150, previously described with respect to FIG. 2, is mounted to circuit board 310. Other elements that may be housed within EAS tag 10 include microprocessor 320, infrared communication port 330, audible alarm generator 340, light emitting diode 350, and battery 360, many of which may mount directly to circuit board 310. Additionally, housing 10 may also carry a core and coil electronic article surveillance element 370.

Circuit board 310 and microprocessor 320 are capable of storing machine readable instructions and are programmable to monitor the status of EAS tag 10 and to communicate with remote programmers and other elements of an EAS system. Circuit board 310 and microprocessor 320 may be reprogrammed via communication with hand held remotes, such as handheld remote 180 in FIG. 3, or other elements of an EAS system when communicating with these devices. In the embodiment shown in FIG. 9, circuit board 310 and microprocessor 320 can communicate via infrared communication port 330 and also receive programming instructions. Audible alarm generator 340 is capable of generating an audible alarm when EAS tag 10 is tampered with, for example, in an attempted forced separation of housing 20 and base 30 or by the cutting of a section of tape 40. Audible alarm generator 340 may also be used to indicate the status of EAS tag 10 as it is assembled, for example, when circuits are completed via tape segments 40, or when limit switch 190 has been actuated through assembly of housing portion 20 and base portion 30 onto an object. Similarly, LED 350 can be used to provide visual cues for the status of EAS tag 10. Battery 360 generally provides power for the electronic components of EAS tag 10.

EAS element 370 is a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements dissipate their energy and generate a signal at a designed frequency. The EAS system is capable of detecting the signal as an indication of the unauthorized presence of the passive elements and can generate an alarm based on the signal. The EAS elements 370 contained within the embodiment of EAS tag 10 in FIG. 9 is compatible with prior art and legacy systems providing an addition security mechanism. In addition to the prior art system detection of the passive EAS element 370, in some embodiments circuit board 310 and microprocessor 320 can monitor the status of passive element 280 and issue an alarm as well. If microprocessor 320 or circuit board 310 detects energy storage and dissipation activity in the coil, then audible alarm generator 340 may be instructed to generate an alarm or the communication capabilities of the electronics may be employed to broadcast a signal to respective receivers in the broader EAS system to generate an alarm.

Top half 290 of housing 20 provides the necessary apertures for the electronic components of EAS tag 10 to communicate with its environment. Sound apertures 380 allow audible alarms generated by audible alarm generator 340 easier escape to the surroundings, while light apertures 390 are generally aligned with infra red communication port 330 and LED 350 to allow direct line of sight communication via those elements. Light apertures 390 may or may not have some type of translucent covering. Additionally, top half 290 of housing 20 has a dome 400 where blocking pin 200 is housed which provides a visual cue where to apply magnet 280 to allow disengagement of latch 190.

Figure 10:
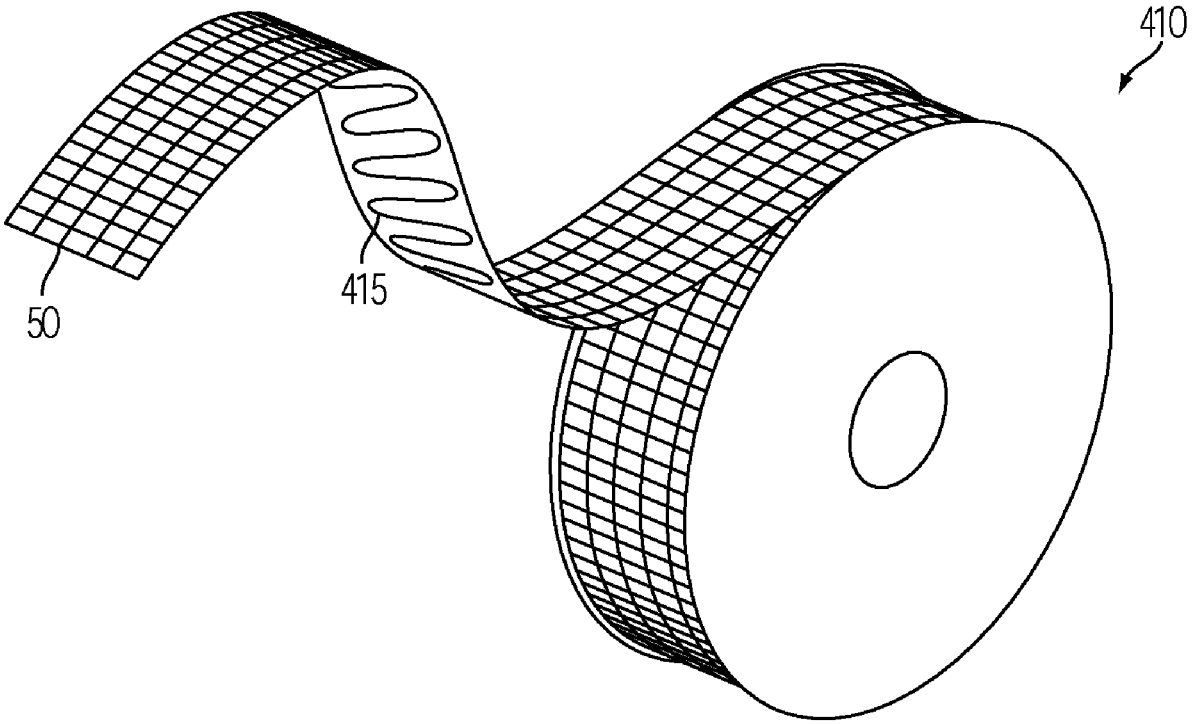
FIG. 10 shows a roll of tape from which segments of tape for embodiments of the present invention may be cut or torn.

FIG. 10 shows a roll 410 of tape having a conductive element 50. As shown in FIG. 10, the tape is elongated, may be packaged as rolls, and has at least one conductive element 50 running along its length. This conductive element 50 may be comprised of a mesh of electrically conductive material exposed on the top surface of the tape. The length of section 40 used from roll 410 will effect the resistance measured as the base line resistance by the electronics of EAS tag 10. Additionally, as shown in FIG. 10, some embodiments of tape may have adhesive element 415 present on either the top or bottom surfaces of the tape, or both. The adhesive element assists retention of tape segments 40 on base 30 and also facilitates the assembly of EAS tag 10 to an object to be protected by providing retention of tape segments 40 to the object itself providing greater stability and control while the elements of EAS tag 10 are assembled on the object. Some embodiments of the tape and tape segments 40 may not have adhesive elements.

Alternatively, limit switch 190 on the bottom of housing 20 may be used to monitor the status of EAS tag 10. When housing 20 is assembled to base 30, limit switch 190 is actuated, informing the circuit board and microprocessor of the status of the tag. Unauthorized separation of housing 20 from base 30 changes the status of limit switch 190 and the electronics of housing 20 will detect this and respond as programmed.

Figure 11:
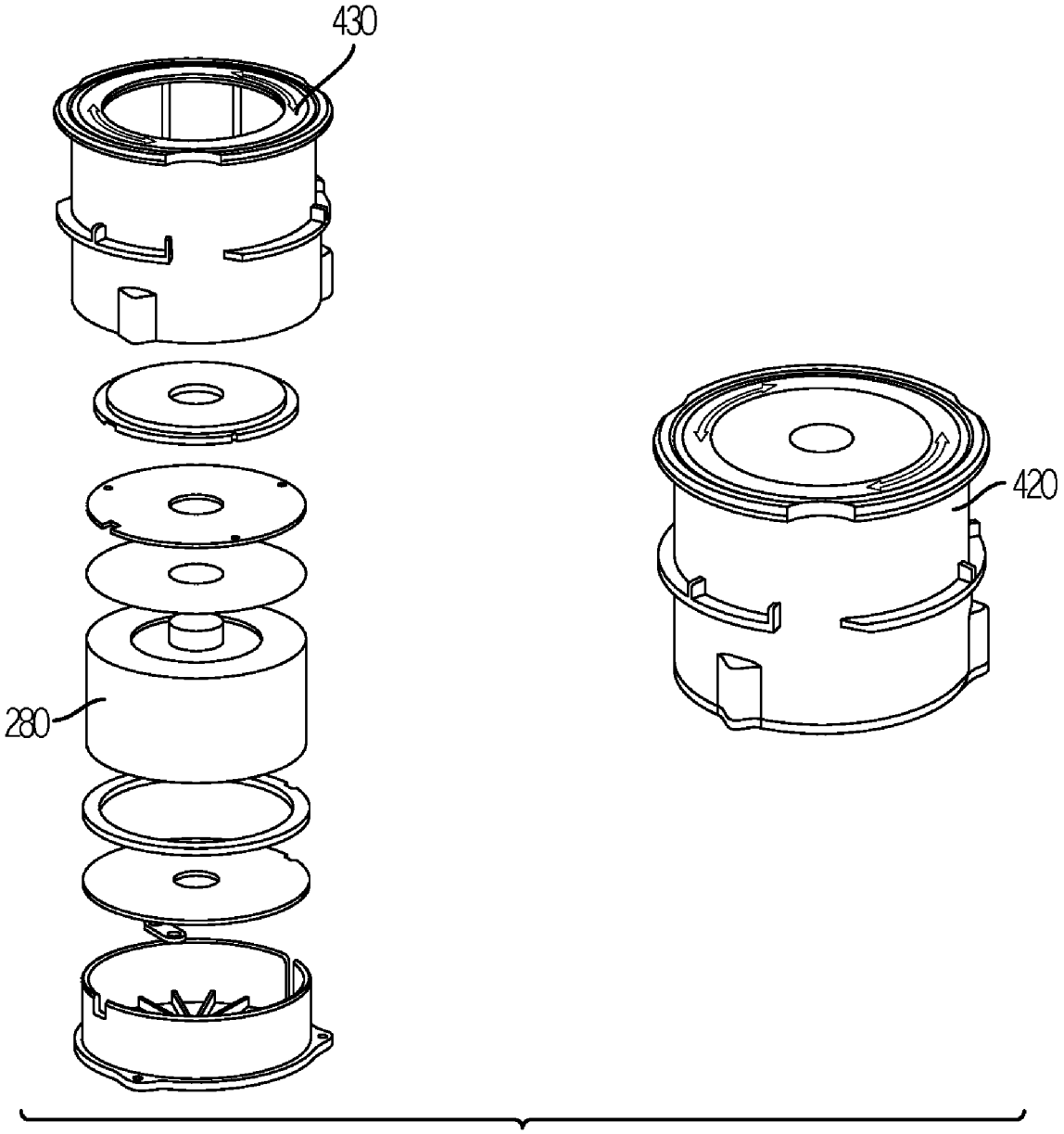
FIG. 11 shows a detacher that may be used with embodiments of the EAS tag of the present invention to activate, deactivate, and detach the various embodiments.

FIG. 11 shows a hand held detacher 420 that may be used with embodiments of the EAS tag of the present invention to activate, deactivate, and detach the various embodiments of EAS tag 10. In FIG. 11, detacher 420 is shown both assembled and exploded into components. Detacher 420 includes magnet 280 as well as some elements of handheld remote 180 described above with respect to FIG. 3. Detacher 420 also has an infrared communication 430 or other communication element. Hand held detacher 420 can communicate with EAS tag 10 to disarm it while magnet 280 of detacher 420 is placed on EAS tag 10 to actuate a release of a latching mechanism in housing 20 and release housing 20 from base 30. Alternatively to infrared communication, radio frequency communication may be used. Once the electronics of housing 20 are disarmed, housing 20 may be lifted from base 30 which will change the status of limit switch 190 and open circuits through tape segments 40, without housing 20 generating an alarm. As described previously, some embodiments of detacher 380 and housing 20 will exchange an encrypted passcode to offer a further level of security. Additionally, some embodiments of EAS tag 10 will have a clock generator and the electronics will have machine readable instructions with an algorithm to alter the passcode at predetermined time intervals. The EAS system will also have at least one clock generator and have machine readable instructions with the same algorithm to continuously update the passcode synchronously with EAS tag 10. Detacher 420 may be powered by a cable 440 connected to an element within the EAS system, or detacher 420 may simply be tethered to another object to prevent it from being mislaid or stolen. In some embodiments cable 440 will provide communication capabilities between a base station and EAS tag 10 via detacher 420.

Figure 12:
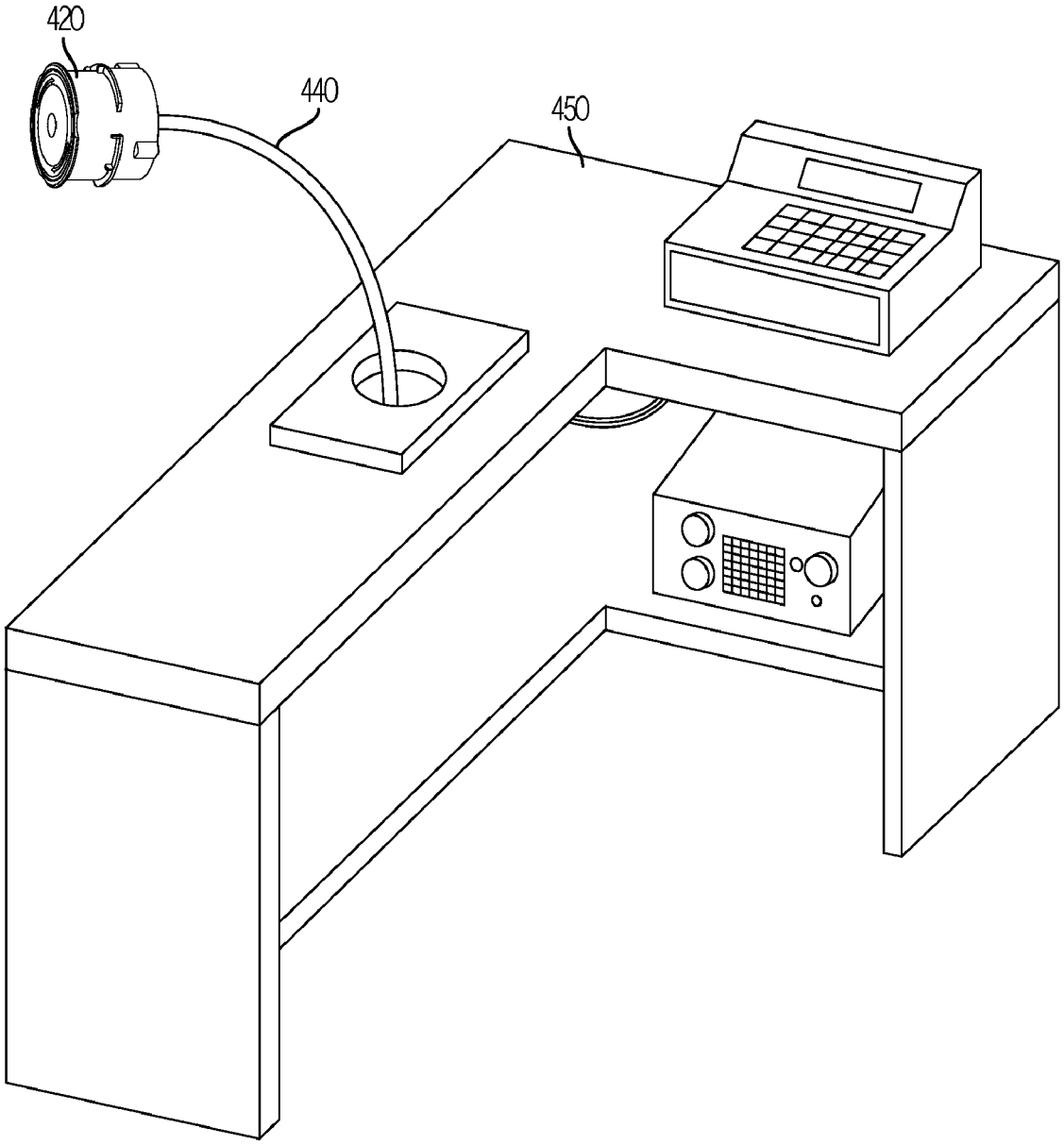
FIG. 12 shows the detacher of FIG. 12 in a retail location along with a base station.

FIG. 12 shows detacher 420 removed from its mount in a retail counter 450. In situations where the object being protected by EAS tag 10 is too large to be placed on a counter, detacher 420 may be extended from its typical position to be applied to the object and detach EAS tag 10. Smaller objects can be applied to detacher 420 as it is mounted in the retail counter 450.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An electronic article surveillance apparatus comprising:

a base portion, said base portion having a top surface, and a bottom surface, said base portion having at least one hinging hook and at least one latch receiver extending upwardly from said top surface;

at least one section of tape, said section of tape having a top surface and a bottom surface and a first end and a second end and being sufficiently long to pass around an object to be monitored with both said first end and said second end being positioned on said base portion, and said at least one section of tape having at least one conductive element, said at least one conductive element running the length of said at least one section of tape, and;

a housing portion housing electronic components and at least one releasable latch, said housing portion having a bottom surface, a top surface and at least one side connecting said bottom surface and said top surface;

said bottom surface of said housing portion having a latch pocket for each said latch receiver on said base portion and at least one set of two electrical contacts, each said latch pocket extending into the interior of said housing and being sized and located to receive a said latch receiver, and each said electrical contact having electrical continuity with the interior of said housing portion and positioned to make contact with said at least one conductive element of said segment of tape, and said electronic components in said housing portion completing electrical continuity within each set of electrical contacts;

said at least one side having a receptacle for each said hinging hook in said base portion, said at least one releasable latch being positioned to releasably engage said at least one latch receiver when said at least one latch receiver is inserted into a latch pocket.

2. The electronic article surveillance apparatus of claim 1, wherein:

said bottom surface of said base portion has an adhesive element on said bottom side.

3. The electronic article surveillance apparatus of claim 1, wherein:

said at least one releasable latch is releasably lockable.

4. The electronic article surveillance apparatus of claim 1, wherein:

said at least one releasably lockable latch is unlocked by application of a magnet.

5. The electronic article surveillance apparatus of claim 1, wherein:

said at least one releasable latch requires manual operation to engage said releasable latch to said at least one latch receiver.

6. The electronic article surveillance apparatus of claim 5, wherein:

said at least one releasable latch may be manually slid to engage said at least one latch receiver;

said electronic surveillance apparatus further comprising a biased blocking component, said biased blocking component moving to a blocking position when said at least one releasable latch is manually slid to engage said at least one latch receiver, thereby blocking the return of said at least one releasable latch;

said biased blocking component being movable to a non-blocking position by application of a magnet to a magnetically attractable element associated with said biased blocking component, the shifting of said biased blocking component to a non-blocking position allowing said at least one releasable latch to be manually shifted to disengage said at least one latch receiver.

7. The electronic article surveillance apparatus of claim 1, wherein:

said electronic components comprise a circuit board, a microprocessor, communication elements, an audible alarm generator, and a battery.

8. The electronic article surveillance apparatus of claim 7, further comprising:

a limit switch on said bottom surface of said housing, said limit switch being in communication with said circuit board;

an aperture through said base portion, said aperture being aligned with said limit switch, and;

a latch switch associated with said at least one releasable latch, said latch switch indicating when said latch is engaged;

wherein, when said at least one set of two electrical contacts experiences a closed circuit, said limit switch detects contact with an object, and said latch switch detects the latch in an engaged state, said electronics determine an installed state for said electronic article surveillance apparatus.

9. The electronic article surveillance apparatus of claim 8, wherein:

if said electronics detect a change in resistance across said at least one set of two electrical contacts or said electronics detects removal of said housing from said object via said limit switch, without authorizing communication being received by said communication elements in said electronics, said electronics determine an alarm condition and generate an alarm.

10. The electronic article surveillance apparatus of claim 9, wherein;

said alarm is an audible alarm.

11. The electronic article surveillance apparatus of claim 9, wherein;

said alarm is an alarm signal broadcast by said communication elements to be received by respective receivers.

12. The electronic article surveillance apparatus of claim 7, further comprising:

machine readable instructions encoded in said microprocessor for storing a passcode.

13. The electronic article surveillance apparatus of claim 12, wherein:

said electronics further comprise an accurate clock generator, and said machine readable instructions further comprise an algorithm for generating multiple passcodes, wherein at specific time intervals said algorithm generates a new passcode and a previously stored passcode is replaced by said new passcode.

14. The electronic article surveillance apparatus of claim 1, further comprising;

a passive electronic article surveillance element.

15. An electronic article surveillance apparatus comprising:

a base portion, said base portion having a top surface, and a bottom surface, said base portion having a first attaching component;

at least one section of tape, said section of tape having a top surface and a bottom surface and a first end and a second end and being sufficiently long to pass around an object to be monitored with both said first end and said second end being positioned on said base portion, and said at least one section of tape having at least one conductive element, said at least one conductive element running the length of said at least one section of tape, and;

a housing portion housing electronic components, said housing portion having a bottom surface, a top surface and at least one side connecting said bottom surface and said top surface, said housing portion having a second attaching component complimentary to said first attaching component on said base portion, said first attaching component and said second attaching component facilitating the releasable attachment of said housing portion to said base portion with said bottom surface of said housing portion facing said top surface of said base portion;

said bottom surface of said housing portion having at least one set of two electrical contacts, each said electrical contact having electrical continuity with the interior of said housing portion and positioned to make contact with said at least one conductive element of said segment of tape, and said electronic components in said housing portion completing electrical continuity within each set of electrical contacts.

16. The electronic article surveillance apparatus of claim 15, wherein:

said second attaching component comprises a releasable latch.

17. The electronic article surveillance apparatus of claim 16, wherein:

said releasable latch is manually engageable to said first attaching component.

18. The electronic article surveillance apparatus of claim 17, further comprising:

said housing portion having a releasable locking mechanism, said releasable locking mechanism preventing the release of said releasable latch.

19. The electronic article surveillance apparatus of claim 18, wherein:

said releasable locking mechanism is released by application of a magnet, the release of said releasable locking mechanism allowing the release of said releasable latch.

20. The electronic article surveillance apparatus of claim 15, wherein:

said electronic components comprise a circuit board, a microprocessor, communication elements, an audible alarm generator, and a battery.

21. The electronic article surveillance apparatus of claim 15, further comprising:

a limit switch extending from the bottom surface of said housing portion and an aperture through said base portion, said aperture through said base portion being aligned with said limit switch when said housing portion is attached to said base portion, said limit switch extending from said housing portion a distance greater that the thickness of said base portion and said limit switch being electrically connected to said electronics.

22. The electronic article surveillance apparatus of claim 15, further comprising:

a passive electronic article surveillance element.

23. The electronic article surveillance apparatus of claim 20, further comprising:

machine readable instructions encoded in said microprocessor for storing a passcode.

24. The electronic article surveillance apparatus of claim 23, wherein:

said electronics further comprise an accurate clock generator, and said machine readable instructions further comprise an algorithm for generating multiple passcodes, wherein at specific time intervals said algorithm generates a new passcode and a previously stored passcode is replaced by said new passcode.

* * * * *